US006620340B2

(12) United States Patent
Deblois et al.

(10) Patent No.: US 6,620,340 B2
(45) Date of Patent: Sep. 16, 2003

(54) METHOD FOR PROVIDING A CORROSION INHIBITING SOLUTION

(75) Inventors: Richard E. Deblois, Ladd, IL (US); Kenneth S. Pisarczyk, Spring Valley, IL (US)

(73) Assignee: Carus Corporation, Peru, IL (US)

( * ) Notice: Subject to any disclaimer, the term of this patent is extended or adjusted under 35 U.S.C. 154(b) by 0 days.

(21) Appl. No.: 10/124,965

(22) Filed: Apr. 18, 2002

(65) Prior Publication Data

US 2002/0114885 A1 Aug. 22, 2002

Related U.S. Application Data

(62) Division of application No. 09/613,023, filed on Jul. 10, 2000, now Pat. No. 6,391,384.

(51) Int. Cl.[7] ..... C09K 15/02; C09K 15/32; B05D 7/00; C23F 11/18

(52) U.S. Cl. ..... 252/389.23; 252/389.52; 252/400.23; 252/400.52; 252/183.14; 134/3; 134/22.11; 422/12; 422/18; 148/413; 148/434; 106/14.12; 427/239; 427/283

(58) Field of Search ..... 252/389.23, 389.24, 252/389.52, 400.23, 400.52, 400.24, 183.14; 422/12, 18; 106/14.12; 134/3, 4, 22.11; 427/239, 283, 435, 436; 148/413, 434

(56) References Cited

U.S. PATENT DOCUMENTS

| | | | | |
|---|---|---|---|---|
| 3,669,901 | A | 6/1972 | Murray | 252/387 |
| 3,931,038 | A | 1/1976 | Mochi-Bartolani et al. | 252/181 |
| 4,089,651 | A | 5/1978 | Scott | 21/2.7 |
| 4,289,547 | A | 9/1981 | King et al. | 148/246 |
| 4,324,684 | A | 4/1982 | Geiger et al. | 252/389 |
| 4,330,345 | A | 5/1982 | Miles et al. | 148/262 |
| 4,411,865 | A | 10/1983 | Geiger et al. | 422/16 |
| 4,497,713 | A | 2/1985 | Geiger | 210/699 |
| 4,659,482 | A | 4/1987 | Chen | 210/699 |
| 4,663,053 | A | 5/1987 | Geiger | 210/699 |
| 4,705,703 | A | 11/1987 | Meier et al. | 427/239 |
| 4,869,845 | A | 9/1989 | Chen | 252/181 |
| 4,913,822 | A | 4/1990 | Chen et al. | 210/699 |
| 5,039,363 | A | 8/1991 | Jo et al. | 148/260 |
| 5,118,367 | A | 6/1992 | Starinshak | 148/262 |
| 5,137,567 | A | 8/1992 | Aubireda Vallvey et al. | 106/14.2 |
| 5,712,236 | A | 1/1998 | Bolkan et al. | 510/259 |
| 5,932,292 | A | 8/1999 | Nagashima et al. | 427/435 |
| 6,379,474 | B1 * | 4/2002 | Mayer et al. | 148/260 |

FOREIGN PATENT DOCUMENTS

| | | | |
|---|---|---|---|
| WO | WO 99/07916 | * | 2/1999 |

OTHER PUBLICATIONS

Worsnop, F.E., et al., "Prevention of corrosion of galvanized iron by glassy metaphosphates," *Chem. Eng. Mining Rev.* , 42–173–6 (1950).

"BetzDearborn Material Safety Data Sheet," BetzDearborn, 2000.

* cited by examiner

*Primary Examiner*—Joseph D. Anthony
(74) *Attorney, Agent, or Firm*—Winston & Strawn

(57) ABSTRACT

The invention is directed to a method for providing a corrosion inhibiting aqueous solution which includes zinc orthophosphate where the zinc orthophosphate is solubilized. The invention is directed to a method of making a substantially contaminant-free, concentrated aqueous solution of zinc orthophosphate from zinc metal or zinc oxide and aqueous phosphoric acid.

5 Claims, No Drawings

METHOD FOR PROVIDING A CORROSION INHIBITING SOLUTION

This is a division of prior application Ser. No. 09/613,023, filed Jul. 10, 2000, now U.S. Pat. No. 6,391,384, which is hereby incorporated herein by reference in its entirety.

BACKGROUND OF THE INVENTION

Water is transported in a variety of metal pipes which include copper, iron and steel pipes. These pipes corrode when exposed to water, even pure water. Most water, however, even drinking water, has salt impurities that promote corrosion. As a result corrosion control agents often are added to the water being conveyed in metal pipes. Zinc phosphate, which is an orthophosphate, is such a known corrosion control agent. It is known that when zinc orthophosphate is added to water being conveyed in water pipes at rates that will result in from about 0.1 to about 10 ppm of zinc phosphate in the water in the pipes, the zinc orthophosphate will deposit a corrosion inhibiting film on the interior surface of the pipes. Current sources of zinc phosphate, however, often are salts such as zinc chloride and zinc sulfate. These salts are sources for contaminant chloride and sulfate anions in solutions of zinc orthophosphate. Even though the contaminant are ions at low concentrations, they are not desirable. Ironically, chloride ions are known to cause corrosion of metals. Sulfate ions often precipitate from solutions of zinc orthophosphate as insoluble inorganic sulfates which is not desirable because such precipitates are solids which eventually block pumps and pipes and threaten the functionality of storage tanks.

Additionally it is desirable to completely minimize sources of contaminants from any water additive to inhibit and control corrosion in metal water pipes because metal pipes often convey drinking water. Hence, care should be taken that the corrosion control additive will eliminate or at least minimize contaminants such as cadmium, copper, chromium, cobalt and mercury.

OBJECTS OF THE INVENTION

It is an object of the invention to provide a method for providing a corrosion inhibiting solution which is substantially free of contaminants such as chloride and sulfate ions.

It is another object of the invention to provide a method of making a solution of zinc orthophosphate which is substantially contaminate free.

It is still another object of the invention to provide a method of inhibiting the corrosion of metal pipes using a contaminant free source of zinc orthophosphate.

These and other objections of the invention will become apparent with reference to the specification herein.

SUMMARY OF THE INVENTION

The invention is directed to a method for providing a corrosion inhibiting aqueous solution which includes zinc orthophosphate where the zinc orthophosphate is solubilized and coats the internal surfaces of water pipes and inhibits the corrosion of such surfaces. The invention is particularly suited for use in connection with pipes which transport drinking water. Further, the invention also involves a method of making a substantially contaminant-free, concentrated aqueous solution of zinc orthophosphate from zinc metal, or zinc oxide, and aqueous phosphoric acid, and in an important aspect, from zinc metal or zinc metal oxide, aqueous phosphoric acid and an oxidizing agent as needed.

In the aspect of the reaction of zinc metal with phosphoric acid, the oxidizing agent is used to take the zinc metal ($Zn^{O}$) to zinc 2+($Zn^{2+}$). The oxidizing agent is not necessary to the reaction of zinc metal oxide with phosphoric acid. The oxidizing agent is in an amount which is effective for promoting the reaction of the zinc metal and aqueous phosphoric acid. Generally this is a stoichiometric amount of oxidant, e.g., one equivalent of oxidant for one equivalent of zinc metal (2 moles of oxidant to get one mole of $Zn^{2+}$). In an important aspect, the oxidizing agent comprises less than about 5 weight percent of the solution of zinc metal and phosphoric acid which is reacted to form the zinc orthophosphate. During the reaction, the oxidant is consumed and oxidant should not be used in any excess that would create more than about 3 weight percent total contaminants in the zinc orthophosphate solution, and preferably less than 1 weight percent contaminants.

The method for supplying a corrosion inhibiting solution includes mixing zinc ion source of zinc metal or zinc metal oxide with aqueous phosphoric acid. The zinc ion source/phosphoric acid mixture has at least less than about 3 weight percent impurities; and in an important aspect, less than about 0.1 to 3 weight percent impurities. The aqueous phosphoric acid is in an amount which is effective for providing a solution having a pH of less than about 2 to provide a corrosion inhibiting concentrate solution. The zinc ion source is in an amount which is effective for providing the concentrate with at least about 0.05 weight percent zinc ions; and in an important aspect, from about 0.1 to about 25 weight percent zinc ions. Generally, the phosphoric acid is in an amount which is effective for providing a phosphate ion concentration of at least about 10 weight percent in the concentrate solution, and in an important aspect, from about 10 to about 70 weight percent phosphate ions. The zinc ion source and the phosphoric acid each should be of a purity such that they should each be substantially free of impurities, that is less than about 1 weight percent impurities, especially substantially free of chloride ion and sulfate ion. To inhibit corrosion, the corrosion inhibiting concentrate solution is mixed into water which is being directed into the metal pipes at a rate which will be effective for providing a deposit of zinc and phosphate film onto the interior surface of the pipes. In one aspect of the invention, the zinc orthophosphate should be in an amount which is effective for providing from about 0.1 to about 10 (ppm) zinc orthophosphate in the water being transported in the metal pipes.

DESCRIPTION OF THE PREFERRED EMBODIMENTS

Definitions

Orthophosphate means the ion [$PO_4^{-3}$].

Zinc orthophosphate means $Zn_3(PO_4)_2$ which is soluble in water.

Zinc metal oxide means zinc oxide, ZnO.

Substantially free of chloride ions means less than about 1 weight percent chloride ions.

Substantially free of sulfate ions means less than about 1 weight percent sulfate.

A solution of zinc orthophosphate substantially free of contaminants means a solution which includes zinc orthophosphate water and which has less than about 1 percent of any other materials.

Oxidizer means an oxidizing agent which is effective to promote the reaction between the zinc ion source, such as the metallic zinc, and phosphoric acid and which is non-toxic to humans at levels not exceeding 5 percent. Such oxidizers include, but are not limited to, peroxide, ozone, potassium, permanganate, and oxygen.

Using zinc metal, the method of the invention relies on the reaction of zinc metal with aqueous phosphoric acid as follows.

$$3Zn+2H_3PO_4+\text{oxidant}\rightarrow Zn_3(PO_4)_2+3H_2(\text{gas})$$

The reaction proceeds in water and because zinc orthophosphate is soluble in water (14 g. per 100 g. solution at 25° C.), the zinc orthophosphate is present as zinc ions and phosphate ions.

The method of the invention which utilizes zinc metal oxide and phosphoric acid reaction proceeds as the following reaction:

$$3ZnO+2H_3PO_4\rightarrow Zn_3(PO_4)_2+3H_2O.$$

The benefit of the invention is that it can take the zinc ion source (zinc metal or zinc metal oxide) which can be economically obtained in pure form and take that zinc ion source directly to the orthophosphate with phosphoric acid which acid also may be obtained in a form without substantial amounts of contaminants. Supplemental acid, if required, can be supplied by any inorganic acid, such as HCl, $HNO_3$, or $H_2SO_4$. The reaction between the zinc ion source and acid provides a pure orthophosphate which is ideal as a pure corrosion control agent for metal water pipes, such as iron, steel and copper water pipes.

The zinc orthophosphate concentrate solution is typically supplied to pipes using a variety of commonly available equipment, such that 0.1 to 10 parts per million of zinc orthophosphate product of the invention is present in the finished water. This level of deposit is effective for inhibiting the corrosion of metal such as cast iron, copper and lead when contacted with such metal for at least two weeks at about 50 to about 70° F. This level of corrosion control agent typically reduces the corrosion rate of the pipe by 20 to 95 percent relative to no treatment with zinc orthophosphate. This rate of corrosion control is dependent upon the raw water quality.

What is claimed is:

1. A method for making a water carrying pipe corrosion inhibitor which comprises making a solution of zinc orthophosphate, by mixing a zinc metal, an aqueous phosphoric acid, and an oxidizer selected from the group consisting of peroxide, $KMnO_4$, ozone, and mixtures thereof in a stoichiometric amount to facilitate conversion of the zinc metal to divalent zinc, to provide an aqueous phosphate mixture, the zinc metal is present in an amount sufficient to provide a zinc ion concentration of at least about 0.05 weight percent in the solution, the aqueous phosphate mixture being substantially free of sulfate ions, chloride ions and other contaminants, and the aqueous phosphoric acid being present in an amount effective for providing the solution with a pH of less than about 2 so as to provide a phosphate ion concentration of at least about 10 weight percent in the solution.

2. The method as recited in claim 1, wherein the oxidizer comprises peroxide.

3. The method as recited in claim 1, wherein the oxidizer comprises $KMnO4_4$.

4. The method as recited in claim 1, wherein the oxidizer comprises ozone.

5. A method for making a water carrying pipe corrosion inhibitor which comprises making a solution of zinc orthophosphate, by mixing a zinc metal, an aqueous phosphoric acid, and an oxidizer selected from the group consisting of peroxide, $KMnO_4$, ozone, and mixtures thereof in a stoichiometric amount to facilitate conversion of the zinc metal to divalent zinc, to provide an aqueous phosphate mixture, the zinc metal being present in an amount sufficient to provide a zinc ion concentration of at least about 0.05 weight percent in the solution, wherein the aqueous phosphate mixture being substantially free of sulfate ions, chloride ions and other contaminants, and the aqueous phosphoric acid is present in an amount effective to provide the solution with a pH of less than about 2 so as to provide a phosphate ion concentration of at least about 10 weight percent in the solution, and mixing the concentrate into drinking water at a rate of from about 0.1 to about 10 ppm as zinc orthophosphate.

* * * * *

UNITED STATES PATENT AND TRADEMARK OFFICE

CERTIFICATE OF CORRECTION

PATENT NO. : 6,620,340 B2 
DATED : September 16, 2003
INVENTOR(S) : Deblois et al.

It is certified that error appears in the above-identified patent and that said Letters Patent is hereby corrected as shown below:

Title Page,
Item [56], References Cited, FOREIGN PATENT DOCUMENTS, please insert:

| | | | |
|---|---|---|---|
| -- FR | 2 262 129 | 2/1974 | |
| FR | 2 262 129 A1 | 9/1975 | |
| EP | 0 006 065 A2 | 12/1979 -- | |

Signed and Sealed this

Thirtieth Day of December, 2003

JAMES E. ROGAN
*Director of the United States Patent and Trademark Office*